United States Patent [19]

Clark et al.

[11] Patent Number: 4,929,877

[45] Date of Patent: May 29, 1990

[54] AUTOMATIC GARAGE DOOR OPERATOR WITH REMOTE LOAD CONTROL

[76] Inventors: John Clark, 2427 Shannondale Rd., Ann Arbor, Mich. 48104; Brian J. Martel, 1560 Robell, Walled Lake, Mich. 48088; James S. Murray, 14403 Dixie, Redford, Mich. 48239

[21] Appl. No.: 356,010

[22] Filed: May 23, 1989

Related U.S. Application Data

[62] Division of Ser. No. 111,408, Oct. 22, 1987, Pat. No. 4,847,542.

[51] Int. Cl.[5] ..... E05F 15/10

[52] U.S. Cl. ..... 318/560; 318/467; 318/468; 340/310 R

[58] Field of Search ..... 318/16, 264, 265, 266, 318/272, 275, 277, 283, 284, 285, 286, 466, 467, 468, 282, 626, 560; 340/310 R, 310 A, 310 CP

[56] References Cited

U.S. PATENT DOCUMENTS

| | | | |
|---|---|---|---|
| 4,360,801 | 11/1982 | Duhame | 318/16 X |
| 4,365,250 | 12/1982 | Matsuoka et al. | 318/16 X |
| 4,385,296 | 5/1983 | Tsubaki et al. | 318/16 X |
| 4,433,274 | 2/1984 | Duhame | 318/16 X |
| 4,464,651 | 8/1984 | Duhame | 318/16 X |
| 4,714,912 | 12/1987 | Roberts et al. | 340/310 R |
| 4,771,218 | 9/1988 | McGee | 318/16 |
| 4,808,995 | 2/1989 | Clark et al. | 318/16 X |

*Primary Examiner*—Bentsu Ro

[57] ABSTRACT

The present invention is an automatic garage door operator with a two button portable controller enabling a secure mode and control of a load remote from the door operator. In accordance with the normal operation of the secure button, actuation when the garage door is closed toggles a secure mode between secure and non-secure states. In the secure state the automatic garage door operator does not move the door upon receipt of a door signal. To open the door when in the secure state the operator must first press the secure button to enter the non-secure state and then press the door button to open the door. The secure button has a secondary function when the garage door is open and the secure state is prohibited. Actuation of the secure button when the door is open toggles the state of a load remote from the automatic garage door operator between an on state and an off state. This control is achieved via a signal modulated on the electric power main.

10 Claims, 8 Drawing Sheets

A
B
313
DOWN LIMIT?
YES
NO
314
PREVIOUS DOWN LIMIT?
YES
NO
315
INDICATOR 137 OFF
316
3RD LOAD OFF
300
317
UP LIMIT?
YES
NO
318
PREVIOUS UP LIMIT?
YES
NO
319
INDICATOR 137 ON
320
INDICATOR 137 BLINK
321
3RD LOAD ON?
YES
NO
322
3RD LOAD ON

AUTOMATIC GARAGE DOOR OPERATOR WITH REMOTE LOAD CONTROL

This application is a division of application Ser. No. 07/111,408, filed on Oct. 22, 1987, now U.S Pat. No. 4,847,542.

FIELD OF THE INVENTION

The field of the present invention is that of automatic garage door operators, and in particular automatic garage door operators which are controlled via a radio frequency link and which can control operations other than the opening or closing of the garage door.

BACKGROUND OF THE INVENTION

The field of automatic garage door openers is well known. Such an automatic garage door opener typically includes a radio frequency transmitter which a user may take with him in the automobile when leaving the garage which generates a radio frequency signal for actuation of the garage door operator. In a typical installation the transmitter transmits an encoded signal which is decoded by the controller for the automatic garage door operator. The controller permits the door actuator to move the garage door only if a particular one of a plurality of codes has been received. This system ensures that any particular garage door operator is responsive to only its associated transmitter and not to all transmitters in the neighborhood.

Lately there has been a trend to employ garage door operators for a variety of auxiliary functions. This type of system is exemplified by U.S. Pat. No. 4,360,801 entitled "Home Security and Garage Door Operator Systems," issued to Duhame on Nov. 23, 1982. In this patent a combined garage door operator and home security system is disclosed. The transmitter includes a second button called a secure button. Upon leaving the house and closing the garage door depression of a secure button sends an encoded signal to a receiver of the garage door operator. Upon reception of this secure signal the garage door operator actuates a security alarm which serves to protect the house from unauthorized entry. The security system disclosed in this patent also includes a carbon monoxide detector which opens the garage door if toxic gas is detected within the garage above a predetermined level. In addition, the garage door operator is insensitive to the signal from the actuation of the door button when the system is in the secure mode. This serves as an additional security function to reduce the possibility of unauthorized entry.

Due to this trend in garage door operator systems, it would be advantageous to find additional uses for the two buttons now included within the transmitter unit.

SUMMARY OF THE INVENTION

The present invention relates to an automatic garage door operator which has an additional feature enabling control of a remote load. In accordance with the present invention the transmitter unit includes a door push-button and a secure push-button. The transmitter unit generates first and second encoded radio frequency signals upon actuation of the door push-button and the secure push-button. In addition, in accordance with the preferred embodiment the radio frequency transmitter includes a house code which is transmitted along with the door or secure signal.

The garage door operator includes a radio frequency receiver which is preferably sensitive only to signals including the house code. The radio frequency receiver detects whether a door signal or a secure signal has been received. A controller then causes the proper action of the door actuator or a line carrier transmitter. If the controller is in a non-secure mode then reception of a door signal causes the door actuator to be triggered to open or close the garage door. In accordance with the prior art receipt of the door signal when the door is fully closed opens the door and receipt of the door signal when the door if fully open closes the door. In the case in which the door is neither fully open or fully closed, receipt of the door signal operates in a four state sequence of: open; stop; close; stop. This four state sequence is known in the art as four phase control. If a secure signal is received when the garage door is closed then the secure/non-secure state of the controller is toggled. That is, if the controller is in the secure state then it enters the non-secure state or if it is in the non-secure state then it enters the secure state. In the secure state the controller does not trigger the door actuator when the door signal is received.

The two push-buttons on the transmitter can be employed for auxiliary signaling purposes in accordance with the present invention. The garage door operator includes a line carrier transmitter which transmits an encoded signal over the electric power main. This encoded signal includes an indication of the house code and an indication of a device code, as well as a command. In accordance with the present invention, actuation of the secure button when the door is not fully closed causes this line carrier transmitter to transmit a signal which will turn a load on or off. This occurs at a remote location in a line carrier receiver which is similarly coupled to the electric power main. This remote receiver, when it receives on the electric power main a signal preceded by the proper house code and device code, can either turn the load on by supplying electric power to the load or turn the load off by inhibiting the supply of electric power. In accordance with the preferred embodiment of the present invention this load is an electric lamp or other appliance.

Further refinements in accordance with the present invention relate to other load control signals transmitted by the line carrier transmitter. In accordance with the preferred embodiment, two differing types of load controls are enabled. In the first type, the load operates in a manner similar to the operation of the known garage door light typically mounted on the garage door operator. That is, whenever the door actuator is started the load is turned on. The load is turned off a predetermined period after the garage door has stopped movement. In a second type of follower function, the load is on only when the garage door is not at the fully closed position. Any time that the garage door is at the fully closed position, then this load is turned off.

In accordance with an alternative embodiment of the present invention, the secure mode operation can be disabled via a switch at the garage door operator. When the secure mode is enabled, operation takes place as described above. If the door is fully closed the secure signal toggles the secure mode between secure and non-secure states, otherwise the secure signal enables the load to be alternatively turned on and off. With the secure mode disabled, the secure signal merely enables the load to be alternately turned on and Off.

BRIEF DESCRIPTION OF THE DRAWINGS

These and other objects and aspects of the present invention will become clear from the following detailed description of the invention in which:

FIG. 3 illustrates a flow charge of the operation of the line carrier controller;

DETAILED DESCRIPTION OF THE PREFERRED EMBODIMENT

Figure 1:
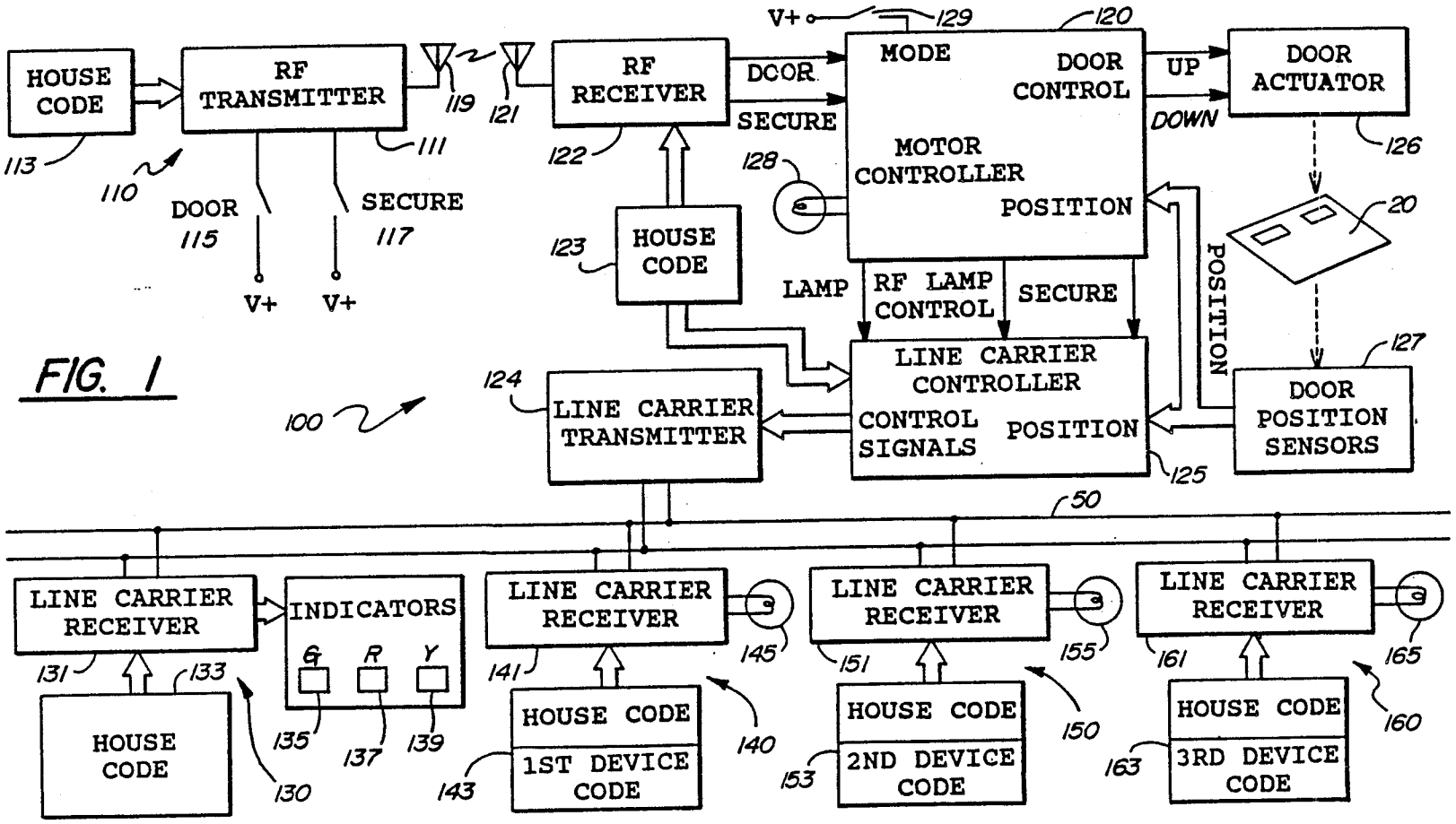
FIG. 1 illustrates a block diagram of the automatic garage operator in accordance with the present invention.

FIG. 1 illustrates automatic garage door operator 100 of the present invention in block diagram form. The automatic garage door operator 100 includes an RF transmitter unit, an RF receiver, a motor controller, a line carrier controller, a door actuator, a line carrier transmitter and one or more remote units which control individual loads.

The RF transmitter unit 110 of automatic garage door operator 100 includes RF transmitter 111, house code unit 113, door push-button switch 115, secure push-button switch 117, and antenna 119. The house code device 113 includes some manner of semi-permanent operator specification of a house code. Because the radio frequency receiver 122 will have a similar house code device 123, it is important that the house code unit 113 of the RF transmitter unit employ the same house code. The only manner to ensure this is to have each of these devices operator settable in some manner. Typically, house code unit 113 will include a plurality of two position switches for specifying the house code. This house code is supplied to radio frequency transmitter 111.

Radio frequency transmitter 111 is keyed by actuation of one of two momentary contact push-button switches. These momentary contact push-button switches are door push-button 115 and secure push-button 117. Depression of door push-button 115 causes radio frequency transmitter 111 to generate a door radio frequency signal at antenna 119 which includes the house code set by house code unit 113. Similarly, depression of secure push-button switch 117 causes radio frequency transmitter 111 to generate a secure radio frequency signal at antenna 119 including the house code specified by house code unit 113. These two signals differ in a manner which permits the receiver to distinguish between them.

The main unit of the automatic garage door operator 100 includes motor controller 120, antenna 121, radio frequency receiver 122, house code unit 123, line carrier transmitter 124, line carrier controller 125, door actuator 126, door position sensors 127, lamp 128 and mode switch 129. Motor controller 120 receives various inputs from other parts of the automatic garage door operator 100 and serves to provide the required signals to control door actuator 126 for raising and lowering garage door 20. In addition, motor controller 120 also provides signals to line carrier controller 125. As illustrated in FIG. 1, these signals are a lamp signal, a RF lamp control signal and a secure signal. Line carrier controller 125 is responsive to these signals and the position signals from door position sensors 127 to control line carrier transmitter 124 for proper signaling the plurality of remote units. In the preferred embodiment both motor controller 120 and line carrier controller 125 are realized in suitably programmed microprocessor devices. In accordance with the prior art each microprocessor device is provided with a control program permanently fixed during manufacture in a read only memory. In this regard line carrier controller 125 is a slave of motor controller 120 performing control of the line carrier signaling function under the control of motor controller 120.

Radio frequency receiver 122 is responsive to radio frequency signals received on antenna 121. In accordance with the preferred embodiment radio frequency receiver 122 is coupled to house code unit 123. House code unit 123 is similar to house code unit 113, in that it permits the operator to semi-permanently specify a particular house code. As noted above it is typical to employ a plurality of two position switches to specify the house code. Radio frequency receiver 122 is constructed so as it is insensitive to received signals except those including the proper house code as set by house code unit 123. Radio frequency receiver 122 generates a pair of signals which are supplied to controller 120. Radio frequency receiver 122 supplies a door signal to controller 120 when the door radio frequency signal is received indicating that the door push-button switch 115 was actuated. Similarly, radio frequency receiver 122 provides a secure signal to controller 120 when the secure radio frequency signal is received indicating that the secure push-button 117 was actuated.

Motor controller 120 is responsive to the door and secure signals received from radio frequency receiver 122. Motor controller 120 generates a pair of door control signals for operation of door actuator 126. Upon generation of an up door control signal, door actuator 126 is operated to raise or open garage door 20. Upon generation of a down door control signal, door actuator 126 is operated to lower or close garage door 20. Door position sensors 127 includes a plurality of door position sensors which in aggregate indicate the position of door 20. A position signal, corresponding to the particular position of door 20 sensed by door position sensors 127 is supplied to motor controller 120. This position signal supplied to motor controller 120 serves as feedback to enable motor controller 120 to properly generate the up and down door control signals.

FIG. 1 further illustrates lamp 128. In accordance with the prior art, lamp 128 is turned on whenever motor controller 120 receives a door signal and remains on for a predetermined period of time. In general, lamp 128 is lighted when garage door 20 is moved either up or down and remains lit for some period after the garage door 20 has stopped movement. In accordance with the preferred embodiment this period during which lamp 128 is on after garage door 20 has stopped moving is switchable between four and one-half minutes and ten minutes.

Mode switch 129 is connected to a mode input of motor controller 120. Mode switch 129 enables switching between a lamp only mode and a lamp/secure mode. The selected mode controls the response of motor controller 120 to the secure signal in a manner that will be fully explained below.

Although not illustrated in FIG. 1, it is conventional to employ wall mounted push button switches in the garage to provide additional input signals. Two buttons can be provided: one for the door signal and one for the secure signal. Actuation of one of these push buttons would provide a corresponding signal to motor controller in the same manner as receipt of a proper RF signal by RF receiver 122.

Line carrier transmitter 124 is responsive to control signals from line carrier controller 125. Line carrier transmitter 124 generates an encoded signal which is modulated on the electric power main 50. Line carrier controller 125 is responsive to at least a portion of the house code provided by house code unit 123. The signal generated by line carrier transmitter 124 includes encoding of this particular house code in accordance with control signals from line carrier controller 125. As in the case of the radio frequency link between radio frequency transmitter 111 and radio frequency receiver 122, the provision of the house code on the encoded signal generated by line carrier transmitter 124 enables more than one system to be used in the same neighborhood without interference. Line carrier transmitter 124 is also responsive to device codes provided by the line carrier controller 125. The particular device code supplied by line carrier controller 125 depends upon the particular signals received from motor controller 120. In accordance with the preferred embodiment the required device codes are permanently stored in the read only memory included within the microprocessor device embodying line carrier controller 125. These device codes are supplied to line carrier transmitter 124 as required for the signaling function desired. This subject matter will be further described below in conjunction with the description of the operation of the line carrier receivers.

Also coupled to the electric power main 50 are remote units 130, 140, 150 and 160. Remote unit 130 is an indicator unit similar to the remote module 14 disclosed in U.S. Pat. No. 4,360,801. Remote units 140, 150 and 160 each control particular corresponding remote devices.

Remote unit 130 includes line carrier receiver 131, house code unit 133 and indicators 135, 137 and 139. Line carrier receiver 131 is connected to electric power main 50, house code unit 133 and indicators 135, 137 and 139. Line carrier receiver 131 is responsive to signals modulated on electric power main 50 including a house code matching the house code provided by house code unit 133. In accordance with this invention house code unit 133 must be set to match the house code of house code unit 123. Line carrier receiver 131 has a fixed device code. The indicator 135 preferably is a green lamp which indicates whether or not remote unit 130 is properly connected to and supplied power from electric power main 50. Indicator 137 is preferably a red lamp. Indicator 137 is illuminated when garage door 20 is open and switched off when garage door 20 is closed. In accordance with the present invention indicator 137 is in a blinking state when garage door 20 is neither fully open nor fully closed. Indicator 139 is preferably a yellow lamp. Indicator 139 is preferably illuminated when control 120 is in the secure mode and off when in non-secure mode. Line carrier receiver 131 receives signals from line carrier transmitter 124 via electric power main 50 in a manner which will be further described below for control of indicator 135 and 137.

Each of the other illustrated remote units 140, 150 and 160 has a similar structure. This includes a line carrier receiver (141, 151, 161), a house code/device code unit (143, 153, 163) and a load device, which in these cases is illustrated as lamp (145, 155, 165). Each house code/device cOde unit 143, 153 and 163 employs the same house code as used in house code units 113, 123 and 133. These three house code/device code units employ differing device codes. House code/device code unit 143 employs the first device code, house code/device code unit 153 employs the second device code and house code/device code unit 163 employs the third device code. The associated line carrier receivers (141, 151, 161) are responsive only to signals including the particular house code set by its respective house code/device code unit. In addition, the particular line carrier receiver is further responsive only to signals including the respective device code specified by the corresponding house code/device code unit. In accordance with the preferred embodiment of the present invention line carrier controller 125 sends differing load signals to line carrier transmitter 124, which generates signals modulated on electric power main 50 having differing device codes for control of the differing line carrier receivers and their respective load devices.

FIG. 2 illustrates program 200 which shows the operation of motor controller 120 in accordance with the preferred embodiment of the present invention. FIG. 2 illustrates program 200 suitable for performance by a microprocessor device having a suitable program fixed in manufacture. However, those skilled in the art will understand that this program is of the type that could be executed using hardware logic circuits. As noted above line carrier controller 125 is a slave to motor controller 120 in the preferred embodiment. The program of line carrier controller 125 will be discussed below in conjunction with FIG. 3.

Program 200 begins with a short testing loop. Program 200 tests to determine whether or not an input signal has been received (decision block 201) from the remote unit 110, whether or not the door is moving (decision block 202) or whether or not a lamp time out has occurred (decision block 203). Information regarding the receipt of an input signal is applied to motor controller 120 via RF receiver 122. Information on whether or not the door is moving and information regarding the lamp time out is handled internally within motor controller 120. In accordance with the preferred embodiment, the microprocessor device embodying motor controller 120 includes some method of detecting the passage of time for certain of the control functions. Program 200 continually makes the tests of decision blocks 201, 202 and 203 and branches to appropriate operating subroutines in the event that one of these tests is met.

If program 200 determines that a lamp time out has occurred (decision block 203) then motor controller 120 controls the lamp functions. Firstly, motor controller 120 turns lamp 128 off (processing block 204). This process includes setting the lamp signal supplied to line carrier controller 125 to a logical low. As detailed below in conjunction with FIG. 3, line carrier controller 125 controls the second load in conjunction with this lamp signal. Both lamp 128 and the second load were turned on in conjunction with movement of the garage door 20, in a manner that will be detailed below. After these processes program 200 returns to the beginning of the testing loop at entry point A. As will be described below, in accordance with the preferred embodiment of the present invention, the length of time of the lamp time out function is operator-selectable between four and one-half minutes and ten minutes.

On the other hand, in the event that program 200 detects that the door is moving (decision block 202), then program 200 performs a number of tests relating to the movement of the door. Firstly, program 200 detects whether or not an obstruction has been encountered (decision block 205). In accordance with the preferred embodiment, door position sensors 127 further include means for detecting whether or not the door has encountered some obstruction during its travel. A number of such obstruction detectors are known in the art. In the event that such obstruction is encountered, then program 200 enters a subroutine to respond to this obstruction.

In the event that such an obstruction has not been detected, then program 200 tests to determine whether or not a motor time out has occurred (decision block 206). In accordance with the preferred embodiment of the present invention, motor controller 120 includes a motor timer which is employed to determine whether or not the door actuator 126 has operated for longer than a predetermined period of time. This motor timer is set for a length which is slightly longer than the longest expected time for the motor to either completely open from the closed position or completely close from the open position, which ever time is longer. The motor time out function is included within motor controller 120 in order to respond to the case in which door actuator 126 has been operating for longer this predetermined period of time. In accordance with the prior art, it is expected that some sort of trouble has occurred if the door actuator 126 has operated for longer than this predetermined period of time. This motor time out function is known in the prior art. In the event that either an obstruction is detected or motor time out is detected, program 200 then enters a subroutine to respond to these conditions. However, if neither of these eventualities has occurred, then program 200 goes to a subroutine at entry point B which performs additional functions regarding the control of the door.

There will now be described a short subroutine which is entered when either an obstruction is detected (decision block 205) or motor time has occurred (decision block 206). Firstly, the motion of the door is stopped (processing block 207). This is achieved by motor controller 120 sending the proper signal to door actuator 126. The stopping of the door also involves the resetting to zero of the timer for motor time out. This motor timer is not started until some commanded motion of the door. Next, program 200 sequences the four phase logic flags (decision block 208). As noted above, in accordance with the prior art in the preferred embodiment of the present invention, the detection of the door signal enables motor controller 120 to step between four states: door opening; stop; door closing; and stop. In the preferred embodiment the four phase logic flags comprise two bits. These two bits indicate the following states: (1) door moving up, (2) door stopped and last movement was up, (3) door moving down, and (4) door stopped and last movement was down. Processing block 208 causes the four phase logic flags to be advanced to the next state in the sequence.

Program 200 next tests to determine the last direction of movement of garage door 20 (decision block 209). This is accomplished by detection of the state indicated by the four phase logic flags. Note that there are two stop states, one if the last movement was upward and the other if the last movement was downward. If the last movement was downward, motor controller 120 controls door actuator 126 to move the door upward (processing block 210). In the case of meeting an obstruction or motor time out, garage door 20 is stopped if the movement was upward but stopped and reversed if going downward. In accordance with the preferred embodiment of the present invention the fully open position is believed safer. Therefore the door is reversed and moved up when an obstruction or motor time out occurs during a closing operation. The upward motion of garage door 20 is stopped when the up limit is reached as further detailed below.

Regardless of whether the door is stopped or stopped and reversed, motor controller 120 causes lamp 128 to blink (processing block 211). This is achieved by periodically turning lamp 128 on and off. This process also controls the lamp signal to line carrier controller 125 to turn on and off. As a consequence, line carrier controller 125 controls the second load to likewise turn on and off. This blinking of lamp 128 serves to alert the operator that either an obstruction or motor time out has occurred. After these processes program 200 returns to the beginning of the testing line at entry point A.

Figure 2A:
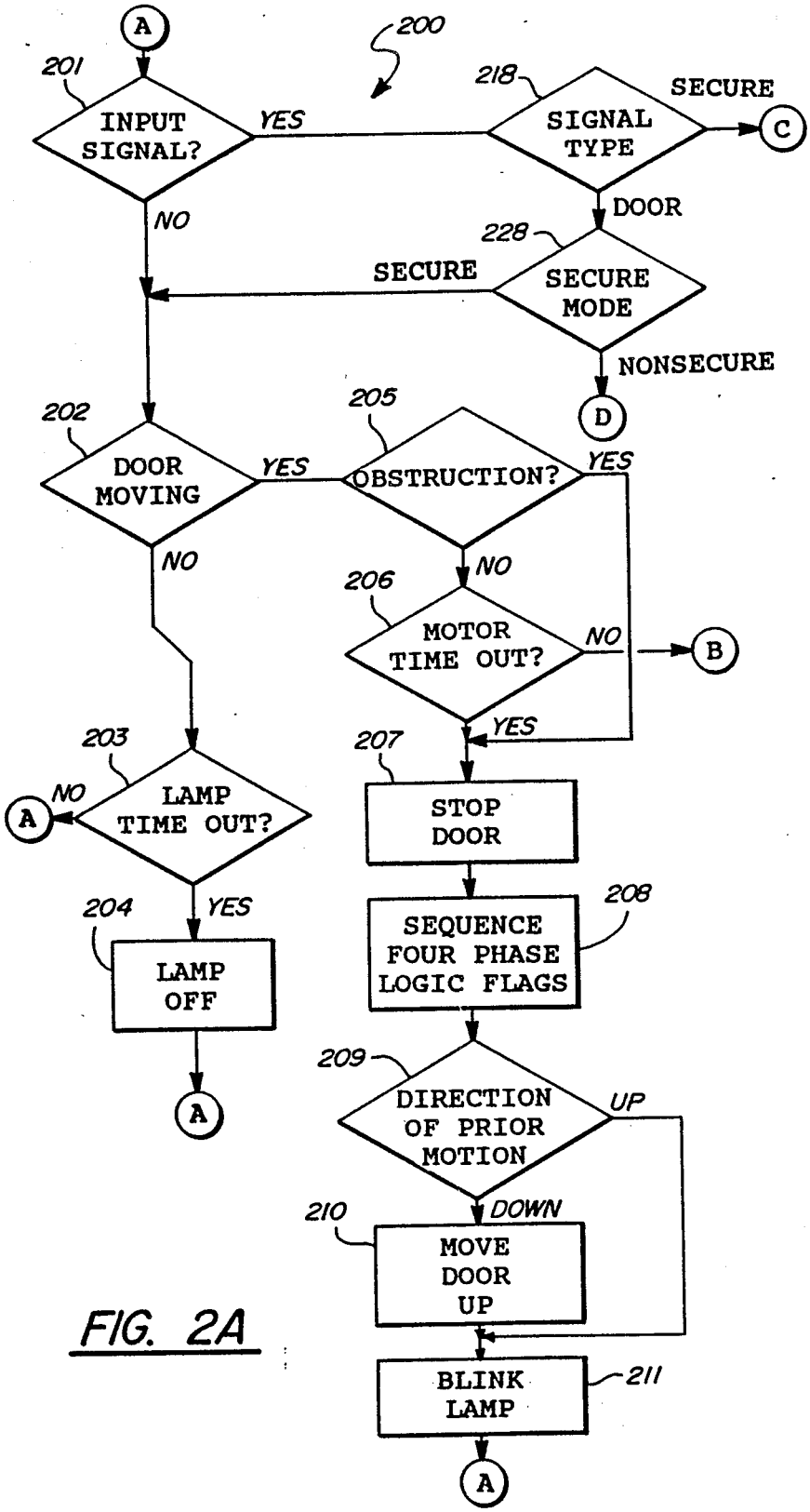
FIGS. 2A–2D illustrate flow charts of the operation of the controller of the automatic garage door operator.
Figure 2B:
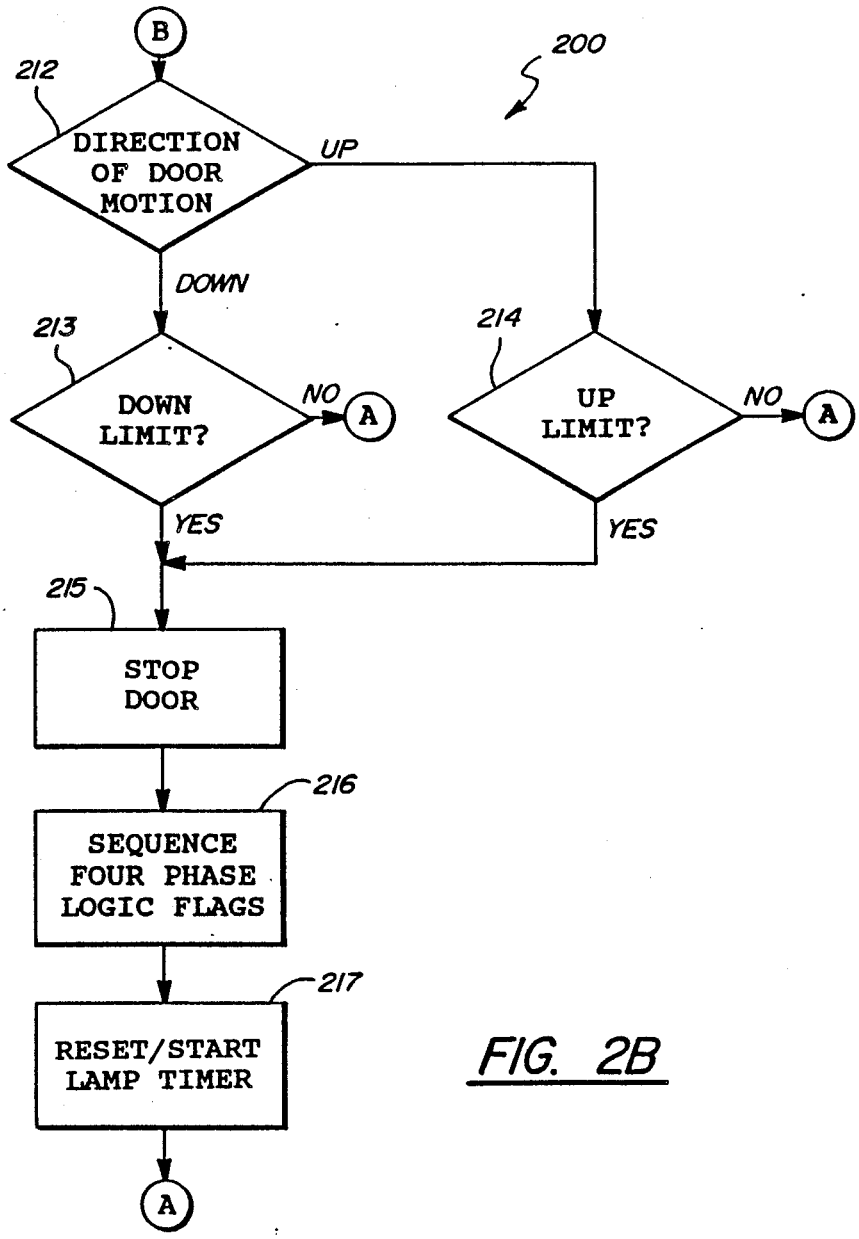

In the event that the door is moving (decision block 202), and neither an obstruction (decision block 205) nor a motor time out (decision block 206) is detected, then program 200 goes to the subroutine illustrated in FIG. 2*b*. The subroutine is entered via entry point B from decision block 206 illustrated in FIG. 2*a*. The subroutine first tests to determine whether or not the door is moving up or down (decision block 212). It has been previously detected that the door is moving (decision block 202 of FIG. 2*a*). If the door is moving down, then program 200 next tests to determine whether or not the door has reached the down limit (decision block 213). In accordance with the preferred embodiment of the present invention, door position sensors 127 include some means for sensing that the door has reached the fully closed position. This fully closed position is referred to as the down limit. If the door has not reached the down limit, then the closing operation is proceeding normally. That is, the door is moving down and neither an obstruction nor a motor time out has been detected and the door has not reached the down limit. Accordingly, the program 200 returns to entry point A of the test loop illustrated in FIG. 2*a*.

In the event the door is not moving down then the door must be moving up. Program 200 tests to determine whether or not the door 20 has reached the up limit (decision block 214). Door position sensors 127 includes some means to detect whether or not the door has reached its fully open position, called the up limit. In the event the door has not reached the up limit, then program 200 returns to the testing routine in FIG. 2*a*. Because the door is moving up and has not met an obstruction, a motor time out or the up limit, the opening operation is proceeding normally and is not complete.

In the event that the garage door 20 has reached either the down limit or the up limit, a short routine is performed. Firstly, the door si stopped (processing block 215). Stopping the door is achieved by sending neither the up nor the down signal to door actuator 126.

The process of stopping the door includes resetting the motor timer, however the motor timer is not started until the door begins to move again. Program 200 then sequences the four phase logic flags (processing block 216) so that garage door opener 100 is ready for the next operation upon receipt of the next door signal. Lastly, the lamp timer is reset and started (processing block 217). This serves to begin the delay period during which lamp 128 and the lamp signal remains on, prior to their being turned off as noted above in relationship to decision block 203 and processing block 204 illustrated in FIG. 2*a*. Note that line carrier controller 125 controls the second load in accordance with the lamp signal from motor controller 120. After completion of these processes, program 200 returns to the initial test loop at entry point A.

Figure 2C:
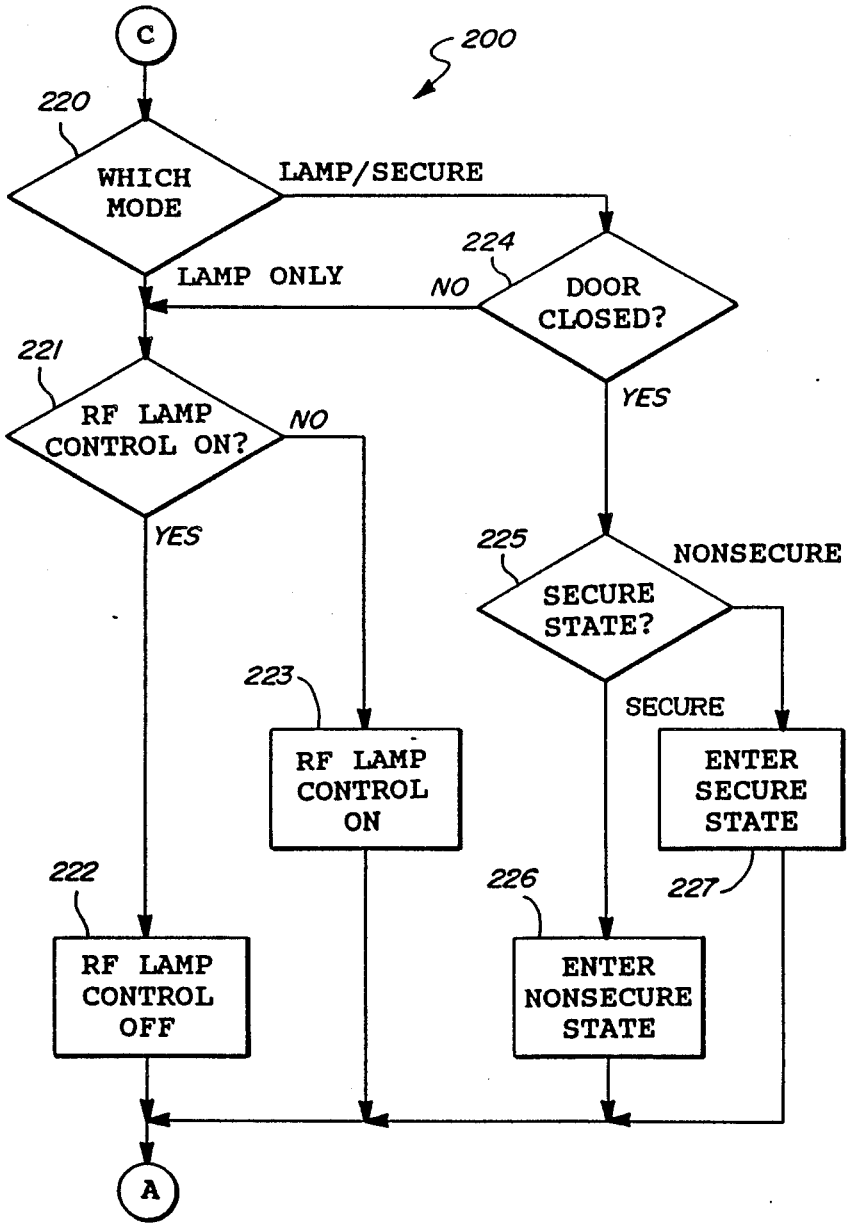
Figure 2D:
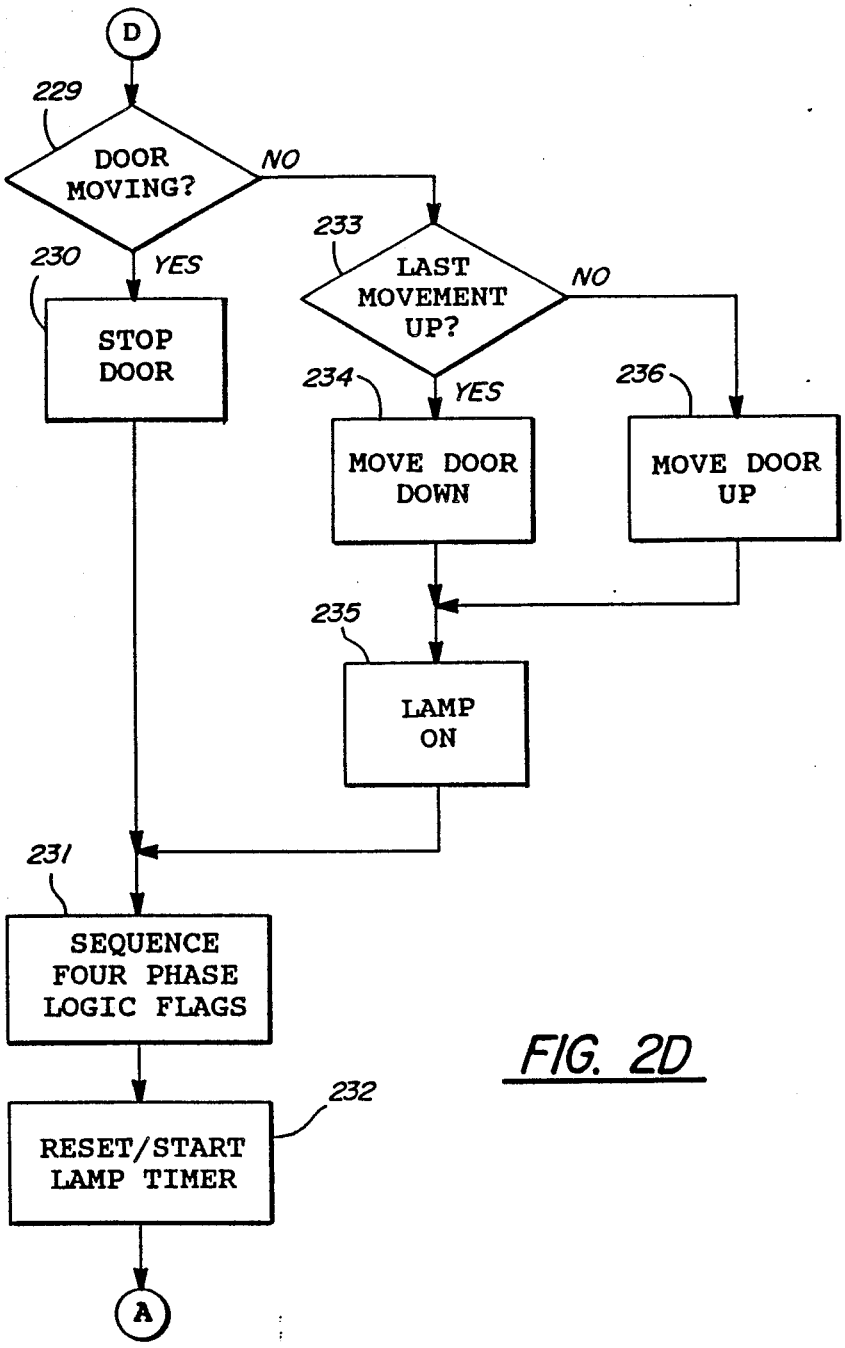

There will now be a discussion of the response when an input signal is received in conjunction with FIGS. 2*c* and 2*d*. If an input signal is received (decision block 210), program 200 tests to determine whether or not this is the secure signal (decision block 218). In the event that this received signal is the secure signal, then program 200 tests to determine the mode of operation of automatic garage door opener 100 (decision block 220 FIG. 2*c*). In accordance with the preferred embodiment of the present invention, automatic garage door operator 100 can operate in one of two modes selected via mode switch 129. In the lamp only mode, depression of secure switch 117 causes the first load to be toggled. In the lamp/secure mode depression of secure switch 117 may either toggle the state of the first load or toggle the secure or non-secure state of garage door operator 100, depending upon the position of garage door 20.

The operation in each of these two modes will now be described. If the garage door operator 100 is in the lamp only mode, then program 200 tests to determine whether the RF lamp control signal is on (decision block 221). If the RF lamp control signal is on, then program 200 turns the RF lamp control signal off (processing block 222). As will be detailed below, this causes line carrier controller 125 to control line carrier transmitter 124 to generate the appropriate signal commanding the first load to be turned off. If, on the other hand, the RF lamp control signal is off, then program 200 causes the RF lamp control signal to be turned on (processing block 223). This change in the RF lamp control signal likewise causes line carrier controller 125 to control line carrier transmitter 124 to generate the appropriate signal commanding the first load to be turned on. Note that in transmission of this signal to the first load it is necessary for line carrier controller 125 to specify the proper house code and first device code for modulation on electrical power mains 50.

If the automatic garage operator 100 is in the lamp/secure mode, then program 200 tests to determine whether or not the garage door 20 is fully closed (decision block 224). This state is sensed by door position sensors 127 in the manner previously disclosed. If garage door 20 is not fully closed, then motor controller 120 operates in the same manner as the case in which the automatic garage door 100 was in the lamp only mode. This is achieved by passing control of program 200 to decision block 221. On the other hand, if the door is closed, then program 200 tests to determine whether or not automatic garage door operator 100 is in the secure state (decision block 225). If automatic garage door operator 100 is in the secure state, then program 200 enters the non-secure state (decision block 226). This involves changing the remembered state within the motor controller 120. It also involves turning off the secure signal transmitted to line carrier controller 125. Line carrier controller 125 is responsive to the secure signal to turn off indicator 139. This is achieved by supplying the proper signals on electric power mains 50 with the command for turning lamp 139 off, thereby indicating the non-secure state. If the automatic garage door operator 100 is not in the secure state, then program 200 causes automatic garage door operator 100 to enter the secure state (processing block 228). The memory of the state within motor controller 120 is changed and the secure signal is turned on. This change in the secure signal causes line carrier controller 125 to control line carrier transmitter 124 to modulate on electric power mains 50 the appropriate signal for turning indicator lamp 139 on. This enables an indication that the electric garage door operator 100 is in the secure state. In any event control of program 200 is returned to the initial test loop via entry point A.

If an input signal has been received and it is not the secure, signal, then program 200 tests to determine whether or not automatic garage door operator 100 is in the secure mode (decision block 228 in FIG. 2*a*). In the event that automatic garage door operator 100 is the secure mode, then motor controller 120 takes no action upon receipt of this door signal. Accordingly, control of program 200 goes to decision block 202 to detect whether or not the door is moving.

If the automatic garage door operator 100 is not in the secure state, the motor controller 120 executes the subroutine illustrated in FIG. 2*d*. Firstly, program 200 tests to determine whether or not the door is moving (decision block 229). As noted above, the detection of whether or not the door is moving is made in regard to the position signals form door position sensors 127. If the door is moving, then program 200 causes the door to stop (processing block 230). This is achieved by sending neither the up or down signal from motor controller 120 to door actuator 126. Stopping the door also includes resetting the motor timer. The motor timer is not started except in conjunction with movement of the door which will be described below. Once the door is stopped, program 200 enables the four phase logic flags to be sequenced (processing block 231) and the lamp timer is reset and started (processing block 232). These processes take place in the manner previously described above. Control of program 200 is then returned to the initial testing loop via entry point A.

In the event that the door is not moving the door must be currently stopped. Program 200 tests to determine whether or not the last movement of the door was upward (decision block 233). This determination is made by reading the current state of the four phase logic flags. If the last movement of door 20 was upward then motor controller 120 controls door actuator 126 for downward movement of garage door 20 (processing block 234). This is achieved by generation of the down signal for application to door actuator 126. Door actuator 126 then begins the movement of garage door 20 downward. This process also includes the starting of the motor timer, thus beginning the interval during which the closing motion of the door must take place or a motor time out is detected at decision block 207 in FIG. 2*a*. Lamp 128 is turned on when this movement starts (processing block 235). At the same time, motor controller 120 causes the lamp signal to turn on. This change in the lamp signal causes line carrier controller 125 to generate the proper signals to line carrier transmitter 124, including the second device code, for signaling remote unit 150. If the door signal is received prior to the expiration of the lamp timer, lamp 128 remains on and the lamp timer is reset. The lamp signal supplied to line carrier controller 125 also remains on. Because line carrier controller 125 is responsive only to the change of state of the lamp signal, no new command is transmitted to turn on the second load. Program 200 next sequences the four phase logic flags (processing block 231), and resets and starts the lamp timer (processing block 232) in a manner previously described and returns to the initial test loop via entry point A.

In the event that the last movement of door 20 was not upward (decision block 233) then this movement must have been downward. Accordingly, motor controller 200 causes door actuator 126 to move the door upward (processing block 236). As in the case of processing block 234 in which the door is moved down, the upward movement of the door causes the motor timer to start. This permits a time out to be detected at decision block 206 of FIG. 2*a* in the event that the door is neither stopped by a door signal nor by reaching the up limit prior to the expiration of this predetermined period of time. Next, motor controller 120 turns on lamp 128 and the lamp signal (processing block 235). Thereafter, the four phase logic is sequenced (processing block 232) and the lamp timer is reset and started (processing block 233). This resetting and starting of the lamp timer ensures that lamp 128 and second load 237 remain on until a lamp time out is detected at decision block 203 of FIG. 2*a*. At completion of this subroutine, control returns to the test loop of program 200 illustrated in FIG. 2*a* via entry point A.

Figure 3A:
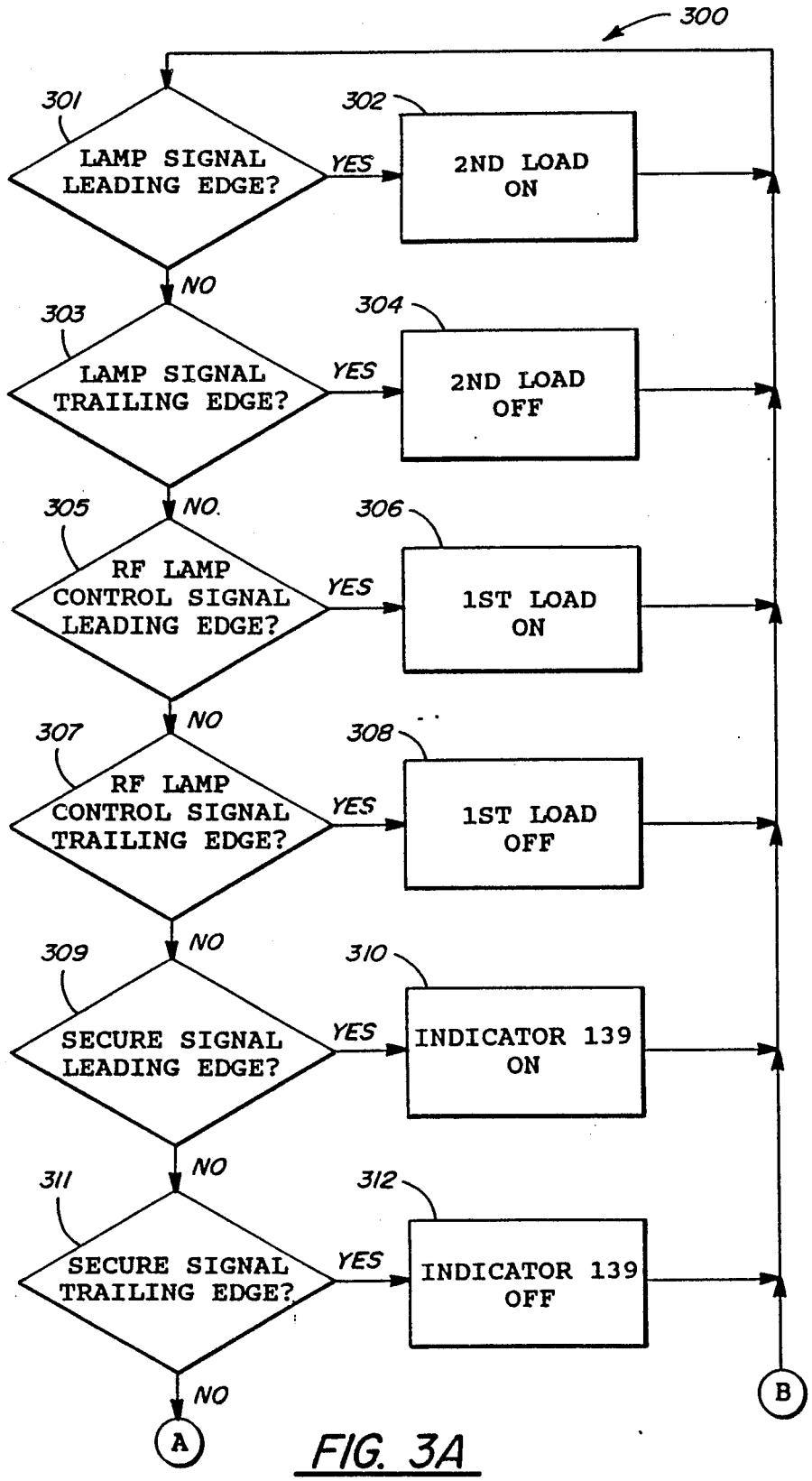
FIGS. 3A–3B illustrate flow charts of the operation of the line carrier controller.
Figure 3B:
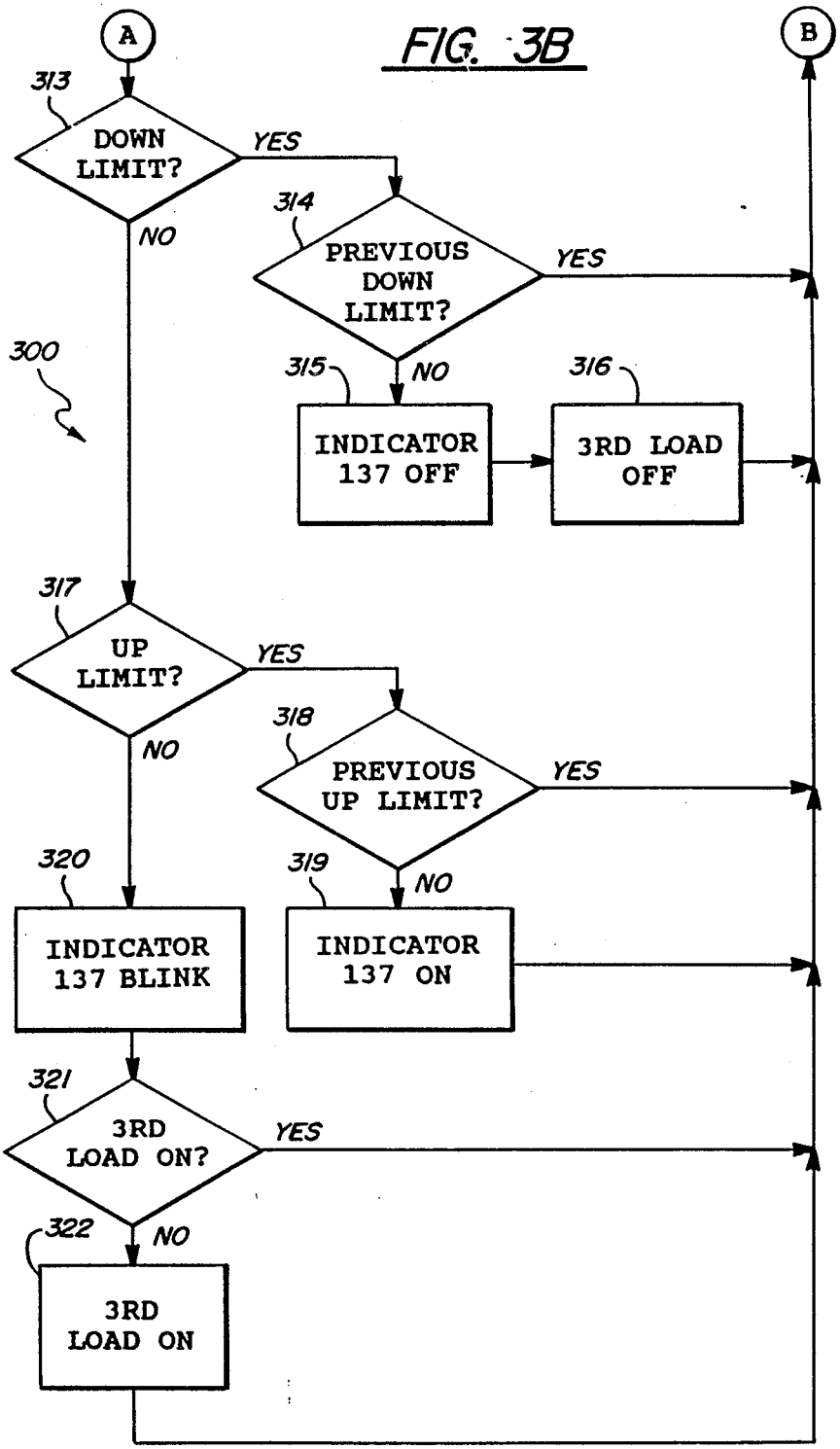

FIG. 3 illustrates program 300 which shows the operation of line carrier controller 125 in accordance with the preferred embodiment of the present. In the preferred embodiment line carrier controller 125 consists of a microprocessor device having a program such as program 300 fixed in manufacture. The details of the specification of the house code and the device code, if needed, are not illustrated in FIG. 3. These features are known in the art and need not be further described.

Program 300 consists of a series of tests with appropriate action based upon the results of these tests. The second load coupled to remote unit 150 is controlled in accordance to the lamp signal from motor controller 120. Upon detection of the leading edge of the lamp signal (decision block 301) indicating that the lamp signal has just switched on the second load is turned on (processing block 302). As noted above, this would involve specification of the house code set by house code unit 123, the second device code stored within line carrier controller 125 to line carrier transmitter 124 for transmission of the desired signal via electric power mains 50. This signal is recognized and decoded by remote unit 150, which responds by supplying electric power to the second load. Upon detection of the trailing edge of the lamp signal (decision block 303), line carrier controller 125 causes generation of the signal to turn off the second load (processing block 304). Thus the second load is on when the lamp signal is on and off when the lamp signal is off, following the lamp 128.

The first load is controlled in accordance with the RF lamp control signal. If the leading edge of the RF lamp control signal is detected (decision block 305) indicating that the RF lamp control signal has just turned on, then line carrier controller 125 causes line carrier transmitter 124 to transmit the signal to turn on the first load (processing block 306). Remote unit 140 receives, decodes and recognizes this signal and responds by supplying electric power to the first load. Similarly, if the trailing edge of the RF lamp control signal is detected (decision block 307) indicates that the RF lamp control signal has just turned off, line carrier controller 125 causes generation of the signal to turn off the first load (processing block 308).

Indicator 138 of remote unit 130 is controlled in accordance with the secure signal. Detection of the leading edge of the secure signal (decision block 309) causes line carrier controller 125 to control generation of the house code and the fixed device code to cause remote unit 130 to turn indicator 139 on (procession block 310). Likewise, detection of the trailing edge of the secure signal (decision block 311) causes line carrier controller 125 to control the generation of a signal causing remote unit 130 to turn indicator 139 off (processing block 312).

Both indicator 137 and the third load are controlled in conjunction with the door position signals from door position sensors 127. Program 300 first tests to determine if garage door 20 is at the down limit, that is fully closed (decision block 313). If that is the case, then program 300 tests to determine if garage door 20 was previously at the down limit (decision block 314). If this is the case then no action is taken and program 300 returns to entry point B. If the garage door has newly reached the down limit the indicator 137 is turned off (processing block 315) and the third load is turned off (processing block 316). These steps are achieved by line carrier controller 125 controlling line carrier transmitter 124 to generate the appropriate signals on electric power mains 50 to control remote units 130 and 160.

In the event that garage door 20 is not at the down limit, program 300 tests to determine if garage door 20 is at the up limit indicating the fully open position (decision block 317). If garage door 20 is at the up limit, then program 300 tests to determine if the garage door 20 was previously at the up limit (decision block 318). If the garage door 20 was previously at the up limit then no action is taken and program 300 returns via entry point B. If the garage door 20 has newly reached the up limit, indicator 137 is turned on (processing block 319). This is achieved via the corresponding signal on electric power mains 50. Program 300 then returns via entry point B.

If garage door 20 is at neither the down limit or the up limit, it must be in an in-between position. Indicator 137 is set to a blinking state (processing block 320). This may be achieved by repeatedly transmitting an on command followed by an off command to remote unit 130. Alternatively, remote unit 130 may have the capability of causing this blinking action. In that case line carrier controller 125 causes the transmission of a command to remote unit 130 to enter this blinking state. Program 300 next tests to determine if the last command to remote unit 160 was a command to turn on the third load (decision block 321). If this is the case no action is taken. If the last such command was not an on command, then that on command is transmitted (processing block 322). This process insures that the third load will be turned on regardless of the prior commands. Once this is complete program 300 returns via entry point B.

The result of the processes in accordance with the present invention are summarized below. Remote unit 130 indicates via indicator 137 whether the garage door 20 is fully open, between fully open and fully closed or fully closed. When the garage door 20 is fully open indicator 137 remains on. When the garage door 20 is between the upper and lower limits, indicator 137 is in a blinking state. When the garage door 20 is fully closed, indicator 137 is continuously off. Indicator 139 of remote unit 130 indicates whether or not the automatic garage door opener 100 is in the secure state of not. When in the secure state, indicator 139 is on, otherwise indicator 139 is off.

The first load, such as lamp 145 illustrated in FIG. 1, of remote unit 140 is switched between on and off states in conjunction with the operation of the secure button. In accordance with the present invention, automatic garage door operator 100 operates in two modes: a lamp only mode; or a lamp/secure mode. In the lamp only mode, receipt of the secure signal toggles the state of this first load between on and off. In the lamp/secure mode the state of the first load is toggled between on and off only during the times in which garage door 20 is not fully closed. When garage door 20 is fully closed, actuation of the secure button 117 toggles the secure state between secure and non-secure.

The second load, such as lamp 155 of remote unit 150, mimics the action of the lamp 128 mounted on the main unit of the automatic garage door operator 100. This second load is turned on when any motion of the door is begun and this lamp remains on until a predetermined period of time after the motion of the door has stopped. This cessation of the motion of the door could result from the garage door 20 reaching its upper or lower limit in accordance with its movement, the receipt of an obstruction signal or a motor time out, or receipt of a further door signal during the motion of the door. In any event, in accordance with the preferred embodiment, this time delay is operator-selectable between four and one-half minutes and ten minutes.

The third load, such as lamp 165 which is a part of remote unit 160, is on any time the garage door 20 is not fully closed and is off when garage door 20 is fully closed.

The above process illustrated in FIGS. 2 and 3 can be achieved by hardware logic rather than a microprocessor device. This is achieved by proper logical combination of the input signals (the door signal and secure signal), the position signal (door open and door closed) and the secure or non-secure state. The desired result is found by reference to Table 1 which indicates the desired action based upon the state of the motor controller 120 when in the

TABLE 1

| | door closed non-secure | door closed secure | door not closed |
|---|---|---|---|
| door signal | open | no action | according to four phase logic |
| secure signal | secure | non-secure | toggle load |

When in the lamp only mode the control action is even simpler. The motor controller 120 always acts in accordance with the four phase logic upon receipt of the door signal. The state of the first load is toggled in response to the secure signal regardless of the state of door 20.

Figure 4:
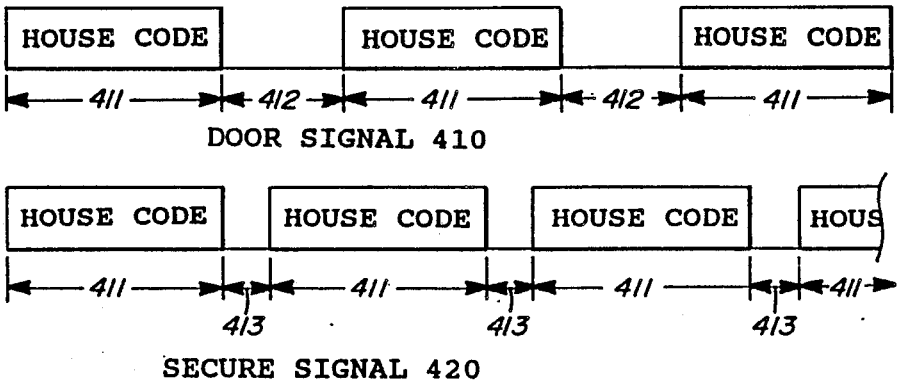
FIG. 4 illustrates the preferred embodiment of the encoding technique for the door signal and the secure signal transmitted by the radio frequency transmitter.

FIG. 4 illustrates the protocol for the generation of the door signal and the secure signal by radio frequency transmitter 111. These signals are generated by radio frequency transmitter 111 and are modulated on a radio frequency carrier for transmission via antenna 119. The house code 411 is specified by house code unit 113 which is preferably manually set by the operator prior to use of the automatic garage operator system. In accordance with the preferred embodiment of the present invention the house code includes ten bits. As illustrated in FIG. 4, door signal 410 includes repeated generation of house code 411 followed by unmodulated intervals 412. In accordance with the preferred embodiment the unmodulated intervals 412 are approximately 75% as long in time as house code 411. Secure signal 420 includes similar repeated generation of house code 411 with shorter unmodulated intervals 413. In accordance with the preferred embodiment the unmodulated intervals 413 are approximately 15% as long in time as house code 411. RF receiver 122 distinguishes between the two unmodulated intervals 412 and 413 on the basis of time.

Figure 5:
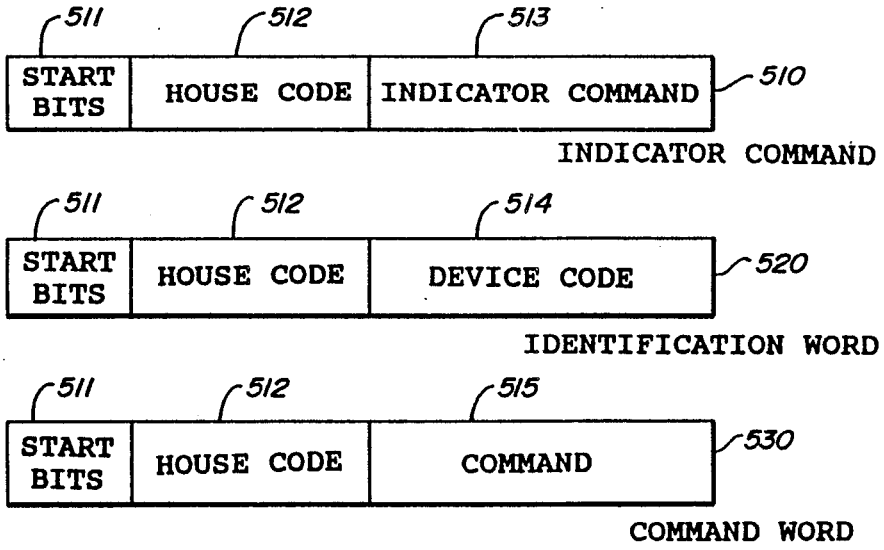
FIG. 5 illustrates the preferred embodiment of the encoding technique for the signals transmitted by the line carrier transmitter.

FIG. 5 illustrates the protocol of commands transmitted on electric power main 50 by line carrier transmitter 124 in accordance with the preferred embodiment. The protocol includes an indicator command word 510 used to signal remote unit 130 and a pair of words including identification word 520 and command word 530 used to signal remote units 140, 150 and 160. Each word begins with start bits 511. Start bits 511 are a predetermined set of ones and zeros employed to ensure that the line carrier receiver is properly synchronized with line carrier transmitter 124 for decoding the signals prior to transmission of the house code. In the preferred embodiment there are four start bits within start bits 511. In the preferred embodiment house code 512 is a four bit subset of the house code 411 employed in the RF transmission. House code unit 133 and house code/device code units 143, 153 and 163 must be set to be responsive to the house code transmitted by line carrier transmitter 124. This house code is preferably a four bit subset of the ten bit house code of house code unit 123.

Signaling remote unit 130 does not require a device code. The command to be performed by remote unit 130 is specified by indicator command 513. This indicator command 513 may command indicator 137 to be on, off or blinking, or command indicator 139 to be on or off as noted in the explanation of the invention above. Signaling remote units 140, 150 and 160 requires both an identification word 520 and a command word 530. As described above, line carrier transmitter 124 modulates these two words upon electric power main 50 for transmission to the plurality of remote units. In accordance with the preferred embodiment line carrier transmitter 124 generates first an identification word 520 then follows with a command word 530. Both identification word 520 and command word 530 are begun with start bits 511. These start bits 511 are employed for the purpose previously described. In the preferred embodiment these start bits 511 are four bits. Both identification word 520 and command word 530 then follow with house code 512. As noted above, in the preferred embodiment the house code includes four bits. This house code is set by house code unit 123 which controls both the received house code of radio frequency receiver 122 and the transmitted house code of line carrier transmitter 124. Identification word 520 then follows with device code 514. In accordance with the preferred embodiment of the present invention this device code 514 includes five bits. The device code 514 is specified by line carrier controller 125. In accordance with the preferred embodiment of the present invention line carrier controller 125 specifies the first, second or third device code depending upon the particular transmission to be made by line carrier transmitter 124. The specific receiver is sensitive only to its corresponding device code, thereby enabling signals to be sent to multiple receivers without interference. The command word 530 ends with a command code 515. This command code 515 is preferably five bits. Command code 515 is generated by line carrier controller 125 for transmission by line carrier transmitter 124 and indicates the particular operation to be performed by the corresponding line carrier receiver. In accordance with the previous description of the present invention command code 515 can include at least an on command, indicating that the load device should be turned on, and an off command, indicating that the load device should be turned off.

We claim:

1. An automatic garage door operator for controlling a remote load and the position of a garage door comprising:

a radio frequency receiver for generating a door signal upon receipt of a first encoded radio frequency signal and a secure signal upon receipt of a second encoded radio frequency signal;

a door actuator connected to the garage door for operating the garage door; and a controller means connected to said radio frequency receiver, said door actuator and the remote load, said controller means having a secure mode, a non-secure mode, a load on mode and a load off mode for controlling said door actuator to operate the garage door upon receipt of said door signal when said controller means is in said non-secure ode, inhibiting said door actuator to prevent operation of the garage door upon receipt of said door signal when said controller means is in said secure mode, toggling between said secure mode and said non-secure mode upon receipt of said secure signal when the garage door is closed, turning the remote load ON upon receipt of said secure signal when the garage door is not closed and said controller means is in said load off mode, and turning the remote load OFF upon receipt of said secure signal when the garage door is not closed and said controller means is in said load on mode.

2. The automatic garage door operator as claimed in claim 1 for further controlling a second remote load, wherein:

said controller means is further connected to the second remote load and further includes means for turning the second load ON upon receipt of said door signal when said controller means is in said non-secure mode, and turning the second load OFF a predetermined time after movement of the garage door has stopped.

3. The automatic garage door operator as claimed in claim 1 for further controlling a second remote load, further comprising:

a door position sensing means connected to the garage door for indicating whether the garage door is fully closed;

said controller means is further connected to said door position sensing means and the second remote load and further includes means for turning the second load ON when said door position sensing means indicates the garage door is leaving fully closed and said controller means is in said non-secure mode, and turning the second load OFF when said door position sensing means indicates the garage door is fully closed.

4. The automatic garage door operator as claimed in claim 1 for further controlling a second remote load and a third remote load, further comprising:

a door position sensing means connected to the garage door for indicating whether the garage door is fully closed;

said controller means is further connected to said door position sensing means, the second remote load and the third remote load, and further includes means for turning the second load ON upon receipt of said door signal when said controller means is in said non-secure mode, turning the second load OFF a predetermined time after movement of the garage door has stopped, turning the third load ON when said door position sensing means indicates the garage door is leaving fully closed and said controlled means is in said non-secure mode, and turning the third load OFF when said door position sensing means indicates the garage door is fully closed.

5. The garage door operator a claimed in claim 1, further comprising:

a portable radio frequency transmitter having a door push button and a secure push button, said portable radio frequency transmitter for transmitting said first encoded radio frequency signal upon actuation of said door push button and said second encoded radio frequency signal upon actuation of said secure push button.

6. An automatic garage door operator for controlling a remote load and the position of a garage door comprising:

a radio frequency receiver for generating a door signal upon receipt of a first encoded radio frequency signal and a secure signal upon receipt of a second encoded radio frequency signal;

a door actuator connected to the garage door for operating the garage door;

a manual mode switch operable between a load only mode and a load/secure mode;

a controller means connected to said radio frequency receiver, said door actuator, said manual mode switch, and the remote load, said controller means having a secure mode, a non-secure mode, a load on mode and a load off mode for controlling said door actuator to operate the garage door upon receipt of said door signal when said controller means is in said non-secure mode, inhibiting said door actuator to prevent operation of the garage door upon receipt of said door signal when said controller means is in said secure mode, toggling between said secure mode and said non-secure mode upon receipt of said secure signal when the garage door is closed and said manual mode switch is in the load/secure mode, turning the remote load ON upon receipt of said secure signal when the garage door is not closed, said manual mode switch is in said load/secure mode and said controller means is in said load off mode, turning the remote load OFF upon receipt of said secure signal when the garage door is not closed, said manual mode switch is in said load/secure mode and said controller means is in said load on mode.

7. The automatic garage door operator as claimed in claim 6 for further controlling a second remote load, wherein:

said controller means is further connected to the second remote load and further includes means for turning the second load ON upon receipt of said door signal when said controller means is in said non-secure mode, turning the second load OFF a predetermined time after movement of the garage door has stopped.

8. The automatic garage door operator as claimed in claim 6 for further controlling a second remote load, further comprising:

a door position sensing means connected to the garage door for indicating whether the garage door is fully closed;

said controller means is further connected to said door position sensing means and the second remote load and further includes means for turning the second load ON when said door position sensing means indicates the garage door is leaving fully closed and said controller means is in said non-secure mode, and turning the second load OFF when said door position sensing means indicates the garage door is fully closed.

9. The automatic garage door operator as claimed in claim 6 for further controlling a second remote load and a third remote load, further comprising:

a door position sensing means connected to the garage door for indicating whether the garage door is fully closed;

said controller means is further connected to said door position sensing means, the second remote load and the third remote load, and further included means for turning the second load ON upon receipt of said door signal when said controller means is in said non-secure mode, turning the second load OFF a predetermined time after movement of the garage door has stopped, turning the third load ON when said door position sensing means indicates the garage door is leaving fully closed and said controller means is in said non-secure mode, and turning the third load OFF when said door position sensing means indicates the garage door is fully closed.

10. The garage door operator as claimed in claim 6, further comprising:

a portable radio frequency transmitter having a door push button and a secure push button, said portable radio frequency transmitter for transmitting said first encoded radio frequency signal upon actuation of said door push button and said second encoded radio frequency signal upon actuation of said secure push button.

* * * * *

UNITED STATES PATENT AND TRADEMARK OFFICE

CERTIFICATE OF CORRECTION

PATENT NO. : 4,929,877

DATED : May 29, 1990

INVENTOR(S) : John Clark et al.

It is certified that error appears in the above-identified patent and that said Letters Patent is hereby corrected as shown below:

Column 2, line 68, "Off" should be --off--.

Column 3, line 7, after "garage" insert --door--.

Column 3, lines 13 and 14, delete entirely.

Column 6, line 8, "cOde" should be --code--.

Column 6, line 21, "1n" should be --In--.

Column 7, line 49, after "time" insert --out--.

Column 8, line 66, "si" should be --is--.

Column 9, line 20, "210" should be --201--.

Column 9, line 53, "electrical" should be --electric--.

Column 10, line 31, "the" (first Occur) should be --then--.

Column 10, line 36, "form" should be --from--.

Column 10, line 39, "or" should be --nor--.

Column 10, line 39, after "nor" insert --the--.

UNITED STATES PATENT AND TRADEMARK OFFICE

CERTIFICATE OF CORRECTION

PATENT NO. : 4,929,877

DATED : May 29, 1990

INVENTOR(S) : John Clark et al.

It is certified that error appears in the above-identified patent and that said Letters Patent is hereby corrected as shown below:

Column 11, line 37, after "present" insert --invention--.

Column 12, line 10, "138" should be --139--.

Column 13, line 48, after "the" insert --lamp/secure mode--.

Column 15, line 34, "ode" should be --mode--.

Signed and Sealed this

Second Day of July, 1991

*Attest:*

*Attesting Officer*

HARRY F. MANBECK, JR.

*Commissioner of Patents and Trademarks*